US009413070B2

(12) United States Patent
Lee

(10) Patent No.: US 9,413,070 B2
(45) Date of Patent: Aug. 9, 2016

(54) SLOT-TYPE AUGMENTED ANTENNA

(75) Inventor: Joo Yeol Lee, Seoul (KR)

(73) Assignee: BROCOLI CO., LTD., Seoul (KR)

( * ) Notice: Subject to any disclaimer, the term of this patent is extended or adjusted under 35 U.S.C. 154(b) by 128 days.

(21) Appl. No.: 14/354,166

(22) PCT Filed: Nov. 23, 2011

(86) PCT No.: PCT/KR2011/008977

§ 371 (c)(1),
(2), (4) Date: Apr. 25, 2014

(87) PCT Pub. No.: WO2013/065893

PCT Pub. Date: May 10, 2013

(65) Prior Publication Data

US 2014/0313091 A1 Oct. 23, 2014

(30) Foreign Application Priority Data

Nov. 4, 2011 (KR) ..... 10-2011-0114304

(51) Int. Cl.

| | |
|---|---|
| ***H01Q 13/10*** | (2006.01) |
| ***H01Q 9/16*** | (2006.01) |
| ***H01Q 21/26*** | (2006.01) |
| ***H01Q 1/24*** | (2006.01) |

(Continued)

(52) U.S. Cl.

CPC ..... *H01Q 9/16* (2013.01); *H01Q 1/246* (2013.01); *H01Q 5/25* (2015.01); *H01Q 5/371* (2015.01); *H01Q 5/40* (2015.01); *H01Q 13/10* (2013.01); *H01Q 21/26* (2013.01)

(58) Field of Classification Search

CPC ..... H01Q 9/0421; H01Q 5/364; H01Q 9/045; H01Q 13/10; H01Q 21/26; H01Q 9/16; H01Q 5/40; H01Q 5/25; H01Q 5/371; H01Q 1/246; H01Q 1/36; H01Q 7/00; H01Q 9/42

USPC ..... 343/803, 804, 767, 770, 771, 768, 808, 343/809

See application file for complete search history.

(56) References Cited

U.S. PATENT DOCUMENTS 6,842,156 B2 * 1/2005 Shepherd ..... H01Q 11/10 343/792.5
7,268,736 B1 * 9/2007 Tikhov ..... H01Q 1/2208 340/572.7

(Continued)

FOREIGN PATENT DOCUMENTS

JP 02-041003 A 2/1990
JP 02041003 * 2/1990

(Continued)

OTHER PUBLICATIONS

International Search Report for International Application No. PCT/KR2011/008977.

*Primary Examiner* — Sue A Purvis
*Assistant Examiner* — Awat Salih
(74) *Attorney, Agent, or Firm* — LRK Patent Law Firm

(57) ABSTRACT

The present invention relates to an augmented antenna capable of operating in a wider frequency band, and receiving and reradiating radio signals. The augmented antenna includes radiation patterns formed using a plurality of radiation slots having multiple coupling regions. The radiation patterns are symmetrically connected and impedance-matched to transmit and receive radio signals, thereby improving a radio wave propagation environment.

8 Claims, 13 Drawing Sheets

(51) Int. Cl.

| | |
|---|---|
| ***H01Q 5/25*** | (2015.01) |
| ***H01Q 5/371*** | (2015.01) |
| ***H01Q 5/40*** | (2015.01) |

(56) References Cited

U.S. PATENT DOCUMENTS

| | | | | |
|---|---|---|---|---|
| 7,292,196 | B2 * | 11/2007 | Waterhouse | H01Q 13/10 343/767 |
| 8,384,600 | B2 * | 2/2013 | Huang | H01Q 1/38 343/700 MS |
| 2002/0000943 | A1 * | 1/2002 | Oberschmidt | H01Q 13/106 343/767 |
| 2006/0055612 | A1 * | 3/2006 | Kim | H01Q 13/106 343/767 |
| 2006/0132373 | A1 * | 6/2006 | Yuanzhu | H01Q 9/0407 343/767 |
| 2006/0164314 | A1 * | 7/2006 | Yuanzhu | H01Q 13/10 343/770 |
| 2009/0015500 | A1 * | 1/2009 | Hoshiai | H01Q 1/38 343/792.5 |
| 2009/0153409 | A1 * | 6/2009 | Chiang | H01Q 1/243 343/702 |
| 2011/0169707 | A1 * | 7/2011 | van Gils | H01Q 9/0421 343/767 |
| 2012/0044117 | A1 * | 2/2012 | Matsukuma | H01Q 1/36 343/771 |

FOREIGN PATENT DOCUMENTS

| | | | |
|---|---|---|---|
| JP | 04-179304 | A | 6/1992 |
| JP | 04-179305 | A | 6/1992 |
| JP | 09-260925 | A | 10/1997 |
| JP | 2003-124734 | A | 4/2003 |
| JP | 2004-194218 | A | 7/2004 |
| JP | 2006-074188 | A | 3/2006 |
| JP | 2011-024024 | A | 2/2011 |
| KR | 10-2006-0049982 | A | 5/2006 |
| KR | 10-2007-0013445 | A | 1/2007 |
| KR | 10-2011-0031559 | A | 3/2011 |
| KR | 10-2011-0040393 | A | 4/2011 |
| WO | 2006-109663 | A1 | 10/2006 |

* cited by examiner (a)

(b)

(a)

(b)

(a)

(b)

(a)

(b)

(c)

SLOT-TYPE AUGMENTED ANTENNA

TECHNICAL FIELD

The present invention relates to an augmented antenna capable of operating in a wider frequency band, receiving and reradiating radio signals and, more particularly, to an augmented antenna, obtained by forming radiation slot patterns using a plurality of radiation slots having multiple coupling regions, electromagnetically connecting the radiation slot patterns in a symmetrical manner and impedance-matching the radiation slot patterns.

BACKGROUND ART

Recently, a shadow area in which a propagation environment for wireless communication systems such as GSM/PCS/3G/4G is poor has been generated inside buildings as structures of high-story buildings and inner spaces thereof have become more complicated. Accordingly, technologies to solve this problem are needed. To improve propagation environments, a technology using a relay or a technology using a micro base station are used.

The technology using a relay improves propagation environments using two antennas and an active relay which is provided between the two antennas and uses a bidirectional amplification circuit or a passive relay which connects the two antennas through a coaxial cable or a waveguide. Specifically, an antenna is installed outside a building, in which a propagation environment is satisfactory, and connected to a waveguide or a coaxial cable and the waveguide or coaxial cable is connected to an antenna installed in a shadow area inside the building, thereby improving the propagation environment of the shadow area.

The technology using a micro base station improves the propagation environment and coverage of wireless communication using a micro base station such as a pico cell base station or a femto cell base station installed inside a building.

However, the technology using a relay or a micro base station requires high costs to solve ail shadow areas and needs new equipment for band expansion of wireless communication. Furthermore, an external propagation signal and a relayed internal propagation signal overlap in as inside area or a building, which is adjacent to glass windows. Terminals connected to the corresponding wireless communication system may be unintentionally exposed to multi-path fading doe to the aforementioned propagation signal overlap.

Accordingly, it is necessary to develop an antenna capable of contributing to expansion of the coverage of a wireless communication system without generating the aforementioned problem and operating in a wide frequency band.

The present invention has been made to satisfy the aforementioned technical requirements and solves the above-described problems and provides techniques that cannot be easily developed by a person skilled in the art.

DISCLOSURE

Technical Problem

Accordingly, the present invention has been made in view of the above-mentioned problems occurring in the prior art, and it is an object of the present invention to provide an augmented antenna which simultaneously transmits and receives RF signals in a free space having a poor propagation environment to expand the coverage of a wireless communication system.

Another object of the present invention is to provide an augmented antenna for improving a propagation environment without exposing terminals to multi-path fading.

Still another object of the present invention is to provide an augmented antenna for improving a propagation environment at a low cost without increasing the number of relays and micro base stations.

Yet another object of the present invention is to provide an augmented antenna having a wide frequency bandwidth through multi-coupling induction.

Another object of the present invention is to provide an augmented antenna having en antenna pattern for propagation environment improvement, which is formed on a plane, to be applicable to various products in the form of a sheet or sticker.

Still another object of the present invention is to provide an augmented antenna having an antenna pattern for propagation environment improvement, which is formed on a metal plate according to perforation to be applicable to the surfaces of various products in the form of a sheet, sticker or metal plate.

Technical Solution

To accomplish the above objects, according to an embodiment of the present invention, there is provided an augmented antenna, including: a plurality of radiation slots formed in parallel on a substrate in order of resonant frequency and operating with positive signal components; and a plurality of radiation slots formed in parallel on the same substrate in order of resonant frequency and operating with negative signal components, the plurality of radiation slots operating with positive signal components and the plurality of radiation slots operating with negative signal components being arranged in the form of a slot dipole antenna.

The radiation slots operating with positive signal components say be formed at a predetermined interval and electromagnetically connected to form multiple coupling regions between neighboring radiation slots, and the radiation slots operating with negative signal components may be formed at a predetermined interval and electromagnetically connected to form multiple coupling regions between neighboring radiation slots.

The radiation slots operating with positive signal components and the radiation slots operating with negative signal components may be formed in a line on the basis of power feeders.

The radiation slots operating with positive signal components and the radiation slots operating with negative signal components may be formed in a V shape on the basis of power feeders.

The radiation slots operating with positive signal components may include: a first radiation slot operating with a positive signal component; a third radiation slot formed at a predetermined distance from the first radiation slot and having a resonant frequency higher than that of the first radiation slot; a fifth radiation slot formed next to the third radiation slot, at a predetermined distance from the third radiation slot, and having a resonant frequency higher than that of the third radiation slot; a seventh radiation slot foraged next to the fifth radiation slot, at a predetermined distance from the fifth radiation slot, and having a resonant frequency higher than that, of the fifth radiation slot; and a ninth radiation slot formed next to the seventh radiation slot, at a predetermined distance from the seventh radiation slot, and having a resonant frequency higher than that of the seventh radiation slot.

The radiation slots operating with negative signal components may include: a second radiation slot operating with a negative signal component; a fourth radiation slot formed at a predetermined distance from the second radiation slot and having a resonant frequency higher than that of the second radiation slot; a sixth radiation slot termed next to the fourth radiation slot, at a predetermined distance from the fourth radiation slot, and having a resonant frequency higher than that of the fourth radiation slot; an eighth radiation slot formed next to the sixth radiation slot, at a predetermined distance from the sixth radiation slot, and having a resonant frequency higher than that of the sixth radiation slot; and a tenth radiation slot formed next to the eighth radiation slot, at a predetermined distance from the eighth radiation slot, and having a resonant frequency higher than that of the eighth radiation slot.

The radiation slots operating with positive signal components and the radiation slots operating with negative signal components may be formed in a V shape on the basis of power feeders to form a radiation slot pattern, wherein two radiation slot patterns are disposed such that ends of power feeders thereof are connected to each other to form an antenna pattern, the two radiation slot patterns being symmetrical.

The power feeders may be impedance-matched and electromagnetically connected to each other.

The two radiation slot patterns may include a first radiation slot pattern and a second radiation slot pattern, wherein a power feeder of the first radiation slot pattern, with respect to positive signal components, and a power feeder of the second radiation slot pattern, with respect to negative signal components, are impedance-matched and electromagnetically connected to each other, and a power feeder of the first radiation slot pattern, with respect to negative signal components, and a power feeder of the second radiation slot pattern, with respect to positive signal components, are impedance-matched and electromagnetically connected to each other.

The radiation slots operating with positive signal components and the radiation slots operating with negative signal components may be formed in a V shape on the basis of the power feeders to form a radiation slot pattern, wherein foot radiation slot patterns are disposed such that ends of power feeders thereof are connected to form an antenna pattern, the four radiation slot patterns and opposite radiation slot patterns thereof being symmetrical.

The power feeders may be impedance-matched and electromagnetically connected.

The four radiation slot patterns may include a first radiation slot pattern, a second radiation slot pattern, a third radiation slot pattern and a fourth radiation slot pattern, wherein a power feeder of the first radiation slot pattern, with respect to positive signal components, and a power feeder of the fourth radiation slot pattern, with respect to negative signal components, are impedance-matched and electromagnetically connected to each other, a power feeder of the second radiation slot pattern, with respect to positive signal components, and a power feeder of the first radiation slot pattern, with respect to negative signal components, are impedance-matched and electromagnetically connected to each other, a power feeder of the third radiation slot pattern, with respect to positive signal components, and a power feeder of the second radiation slot pattern, with respect to negative signal components, are impedance-matched and electromagnetically connected to each other, and a power feeder of the fourth radiation slot pattern, with respect to positive signal components, and a power feeder of the third radiation slot pattern, with respect to negative signal components, are impedance-matched and electromagnetically connected to each other.

The radiation slots operating with positive signal components and the radiation slots operating with negative signal components may be formed on a substrate disposed on one side of a dielectric layer.

The dielectric layer may be a PCB.

The material of the substrate may be a metal, polysilicon, ceramic, carbon fiber, conductive ink, conductive paste, ITO (Indium Tin Oxide), CNT (carbon Nano Tube) or conductive polymer.

The substrate on which the radiation slots operating with positive signal components and the radiation slots operating with negative signal components are formed may be a metal layer.

The metal layer may be a metal plate.

The metal plate may be formed on the surface of electronics.

Advantageous Effects

An augmented antenna according to an embodiment of the present invention can simultaneously transmit and receive RF signals in a free apace having a poor propagation environment to contribute to expansion of the coverage of a wireless communication system.

An augmented antenna according to an embodiment of the present invention can improve propagation environment without exposing terminals to multi-path fading.

An augmented antenna according to an embodiment of the present invention can improve a propagation environment at a low cost without increasing the number of relays and micro base stations.

An augmented antenna according to an embodiment of the present invention can reradiate radio waves in a wide frequency bandwidth through multi-coupling induction. Accordingly, propagation environment can be improved in a wide frequency band.

In addition, an augmented antenna according to an embodiment of the present invention can be formed in such a manner that an antenna pattern for propagation environment improvement is formed flat on a dielectric layer. Accordingly, the augmented antenna can be manufactured in the form or a sheet or sticker and applied to various products to improve the propagation environment.

Furthermore, an augmented antenna according to an embodiment of the present invention can be formed in such a manner that an antenna pattern for propagation environment improvement is formed on a metal plate according to perforation. Accordingly, the augmented antenna can be manufactured in the form of a sheet, sticker or metal plate and applied to various products to improve propagation environment.

BEST MODE FOR INVENTION

An augmented antenna according to the present invention will be described in detail through preferred embodiments with reference to the accompanying drawings so that the present invention can be easily understood and realized by those skilled in the art. Reference will now be made in detail to the preferred embodiments of the present invention, examples of which are illustrated in the accompanying drawings. The accompanying drawings illustrate exemplary embodiments of the present invention end provide a more detailed description of the present invention. However, the scope of the present invention should not be limited thereto.

Figure 2:
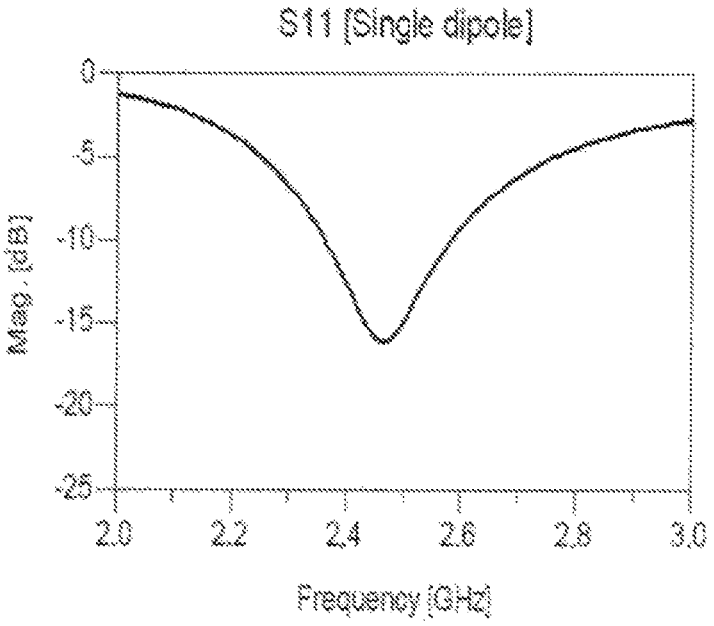
FIG. 2 is a graph showing reflection coefficient characteristics of a linear single slot dipole antenna.
Figure 3:
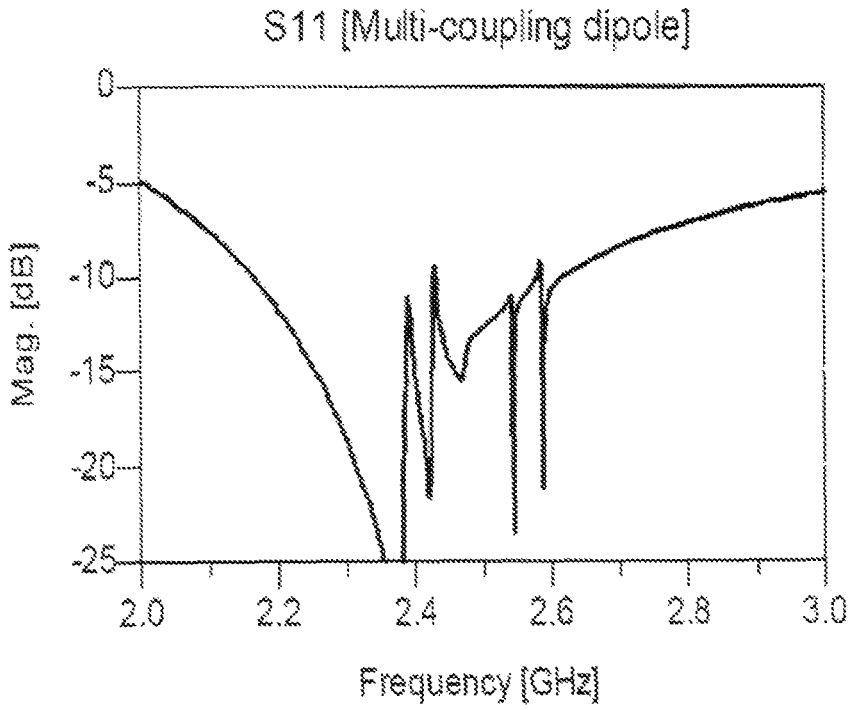
FIG. 3 is a graph showing reflection coefficient characteristics of the linear radiation slot pattern included in the augmented antenna according to an embodiment of the present invention.

A description will be given of a linear radiation slot pattern, which may be included in an augmented antenna according to an embodiment of the present invention with reference to FIGS. 1, 2 and 3.

Figure 1:
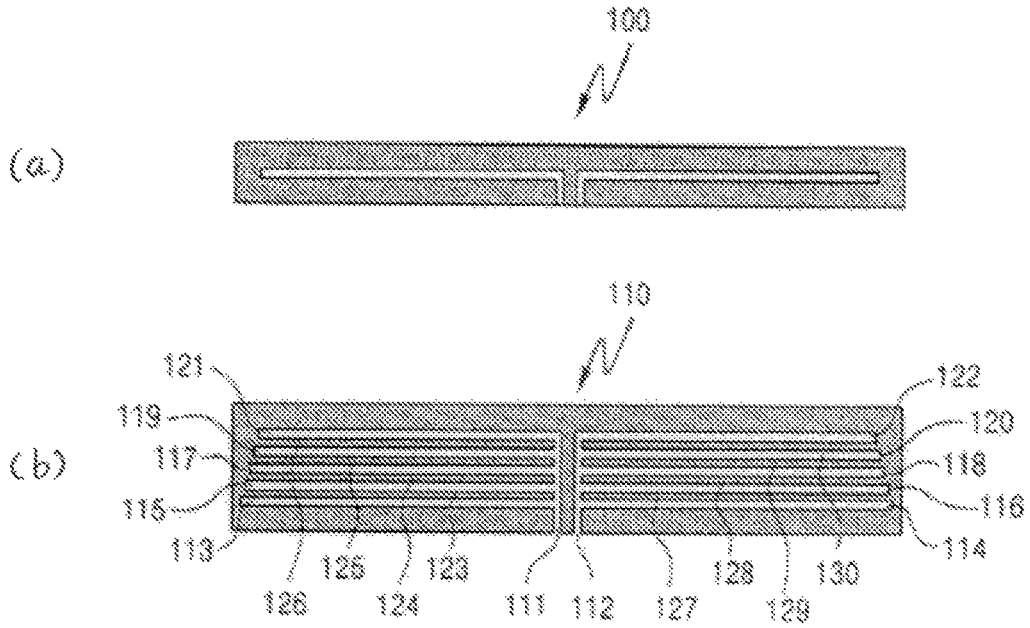
FIGS. 1 (*a*) and (*b*) illustrates a configuration of a linear radiation slot pattern included in an augmented antenna according to an embodiment of the present invention.

Referring to FIG. 1, the linear radiation slot pattern 110 which may be included in the augmented antenna according to an embodiment of the present invention may include a plural icy of radiation slots 113, 115, 117, 119 and 121 which are formed on a substrate in order of resonant frequency and operate with positive signal components, and a plurality of radiation slots 114, 116, 118, 120 and 122 which are formed on the same substrate to constitute a slot dipole antenna with the radiation slots operating with positive signal components, are arranged in order of resonant frequency and operate with negative signal components.

The radiation slots 113, 115, 117, 119 and 121 operating with positive signal components are formed in parallel on the substrate in order of resonant frequency and arranged in a line with the radiation slots 114, 116, 118, 120 and 122 operating with negative signal, components. The radiation slots 113, 115, 117, 119 and 121 and the radiation slots 114, 116, 118, 120 and 122 are arranged in the form of a slot dipole antenna.

The radiation slots 113, 111, 117, 119 and 121 operating with positive signal components are formed at a predetermined interval and electromagnetically connected to a power feeder 111, and thus multi-coupling regions 123, 124, 125 and 126 are formed between neighboring radiation slots.

In addition, the radiation slots 113, 115, 117, 119 and 121 operating with positive signal components respectively have sequentially increasing resonant frequencies. Specifically, the radiation slots 113, 115, 117, 119 and 121 stay include the first radiation slot 113 operating with a positive signal component, the third radiation slot 115 which is formed at a predetermined distance free the first radiation slot and has a resonant frequency higher than that of the first radiation slot, the fifth radiation slot 117 which is formed nest to the third radiation slot, at a predetermined distance therefrom, and has a resonant frequency higher than that of the third radiation slot, the seventh radiation slot 119 which is formed next to the fifth radiation slot, at a predetermined distance therefrom, and has a resonant frequency higher than that of the fifth radiation slot, and the ninth radiation slot 121 which is formed next to the seventh radiation slot, at a predetermined distance therefrom, and has a resonant frequency higher than that of the seventh radiation slot.

The radiation slots 114, 116, 118, 120 and 122 operating with negative signal components are formed in parallel on the substrate in order of resonant frequency and arranged, in a line with the radiation slots 113, 115, 117, 119 and 121 operating with positive signal components. The radiation slots 114, 116, 118, 120 and 122 and the radiation slots 113, 115, 117, 110 and 121 are arranged in the form of a slot dipole antenna.

The radiation slots 114, 116, 118, 120 and 122 operating with negative signal components are formed at a predetermined interval and electromagnetically connected to a power feeder 112, and thus multiple coupling regions 127, 128, 129 and 130 are formed between neighboring radiation slots.

In addition, the radiation slots 114, 116, 118, 120 and 122 operating with positive signal components respectively have sequentially increasing resonant frequencies. Specifically, the radiation slots 114, 116, 118, 120 and 122 may include the second radiation slot 114 operating with a negative signal component, the fourth radiation slot 116 which is formed at a predetermined distance from the second radiation slot and has a resonant frequency higher than that of the second radiation slot, the sixth radiation slot 118 which is formed next to too fourth radiation slot, at a predetermined distance therefrom, and has a resonant frequency higher than that of the fourth radiation slot, the eighth radiation slot 120 which is formed next to the sixth radiation slot, at a predetermined distance therefrom, and has a resonant frequency higher than that of the sixth radiation slot, and the tenth radiation slot 122 which is formed next to the eighth radiation slot, at a predetermined distance therefrom, and has a resonant frequency higher than that of the eighth radiation slot.

While the five radiation slots operating with positive signal components and the five radiation slots operating with negative signal components are shown in FIG. 1, the number of radiation slots is not limited to five and the radiation slot pattern may be formed in various manners using two or more radiation slots.

The linear radiation slot pattern 110 that may be included in the augmented antenna according to an embodiment of the present invention will now be described in more detail with reference to FIG. 1. The first radiation slot 113 operating with a positive signal component and the second radiation slot 114 operating with a negative signal component are formed in a line on oho basis of the power feeders 111 and 112. The third radiation slot 115 having a resonant frequency higher than that of the first radiation slot 113 is formed at a predetermined distance from the first radiation slot 113 and electromagnetically connected to the first radiation slot 113 to form the proximity coupling region 123. The fourth radiation slot 116 having a resonant frequency higher than that of the second radiation slot 114 is formed at a predetermined distance from the second radiation slot 114 and electromagnetically connected to the second radiation slot 114 to form the proximity coupling region 127.

The fifth radiation slot 117 having a resonant frequency higher than that of the third radiation slot 115 is formed at a predetermined distance from the third radiation slot 115 and electromagnetically connected to the third radiation slot 115 to form the proximity coupling region 124. The sixth radiation slot 118 having a resonant frequency higher than that of the fourth radiation slot 116 is formed at a predetermined distance from the fourth radiation slot 116 and electromagnetically connected to the fourth radiation slot 116 to form the proximity coupling region 128.

The seventh radiation slot 119 having a resonant frequency higher than that of the fifth radiation slot 117 is formed at a predetermined distance from the fifth radiation slot 117 and electromagnetically connected to the fifth radiation slot 117 to form the proximity coupling region 125. The eighth radiation slot 120 having a resonant frequency higher than that of the sixth radiation slot 118 is formed at a predetermined distance from the sixth radiation, slot 118 and electromagnetically connected to the sixth radiation slot 118 to form the proximity coupling region 129.

In addition, the ninth radiation slot 121 having a resonant frequency higher than that of the seventh radiation slot 119 is formed at a predetermined distance from the seventh radiation slot 119 and electromagnetically connected to the seventh radiation slot 119 to form the proximity coupling region 126. The tenth radiation slot 122 having a resonant frequency higher than that of the eighth radiation slot 120 is formed at a predetermined distance from the eighth radiation slot 120 and electromagnetically connected to the eighth radiation slot 120 to form the proximity coupling region 130.

The linear radiation slot pattern 110 that may be included in the augmented antenna according to an embodiment of the present invention has the following characteristics. As shown in FIG. 3, reflection coefficient S11 of less than −10 dB of the radiation slot of pattern 110 corresponds to a bandwidth of 400 MHz ranging from 2.2 GHz to 2.6 GHz. Such bandwidth is double the bandwidth of a single slot dipole antenna pattern 100 shown in FIG. 2. Such bandwidth improvement is achieved according to multi-coupling obtained by the radiation slots of the radiation slot pattern 110.

Figure 5:
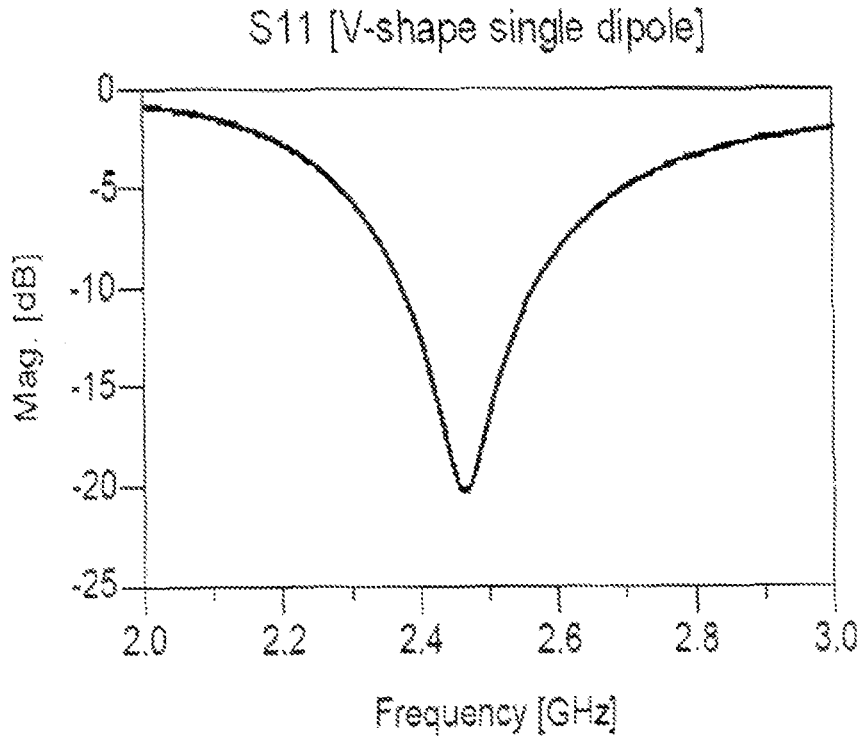
FIG. 5 is a graph showing reflection coefficient characteristics of a V-shaped single slot dipole antenna.
Figure 6:
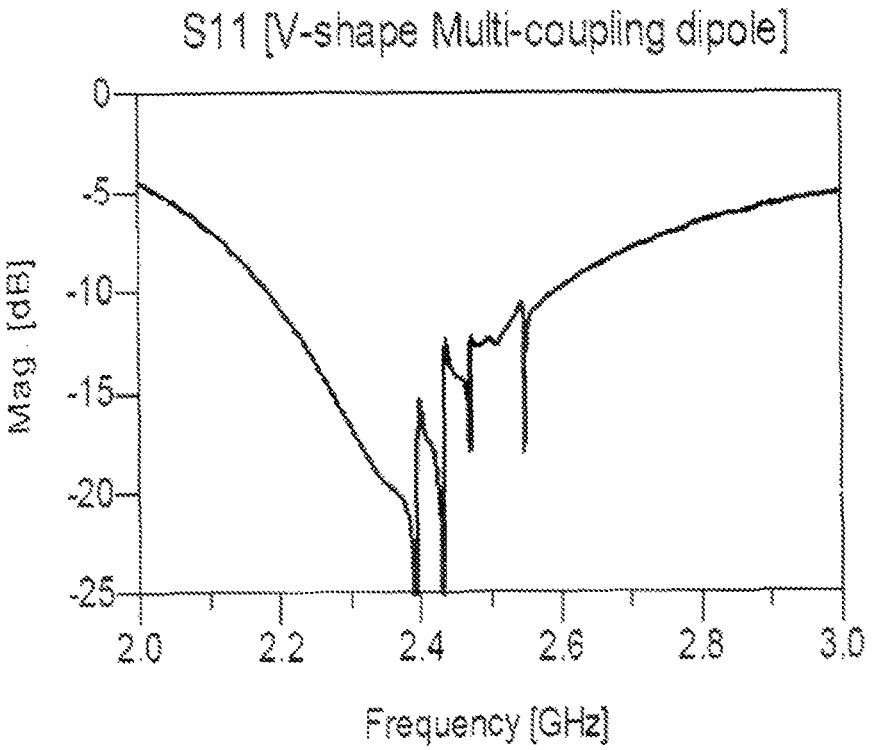
FIG. 6 is a graph showing reflection coefficient characteristics of the V-shaped radiation slot pattern included in the augmented antenna according to an embodiment of the present invention.

A description will be given of a V-shaped radiation slot pattern which may be included in the augmented antenna according to an embodiment of the present invention with reference to FIGS. 4, 5 and 6.

Figure 4:
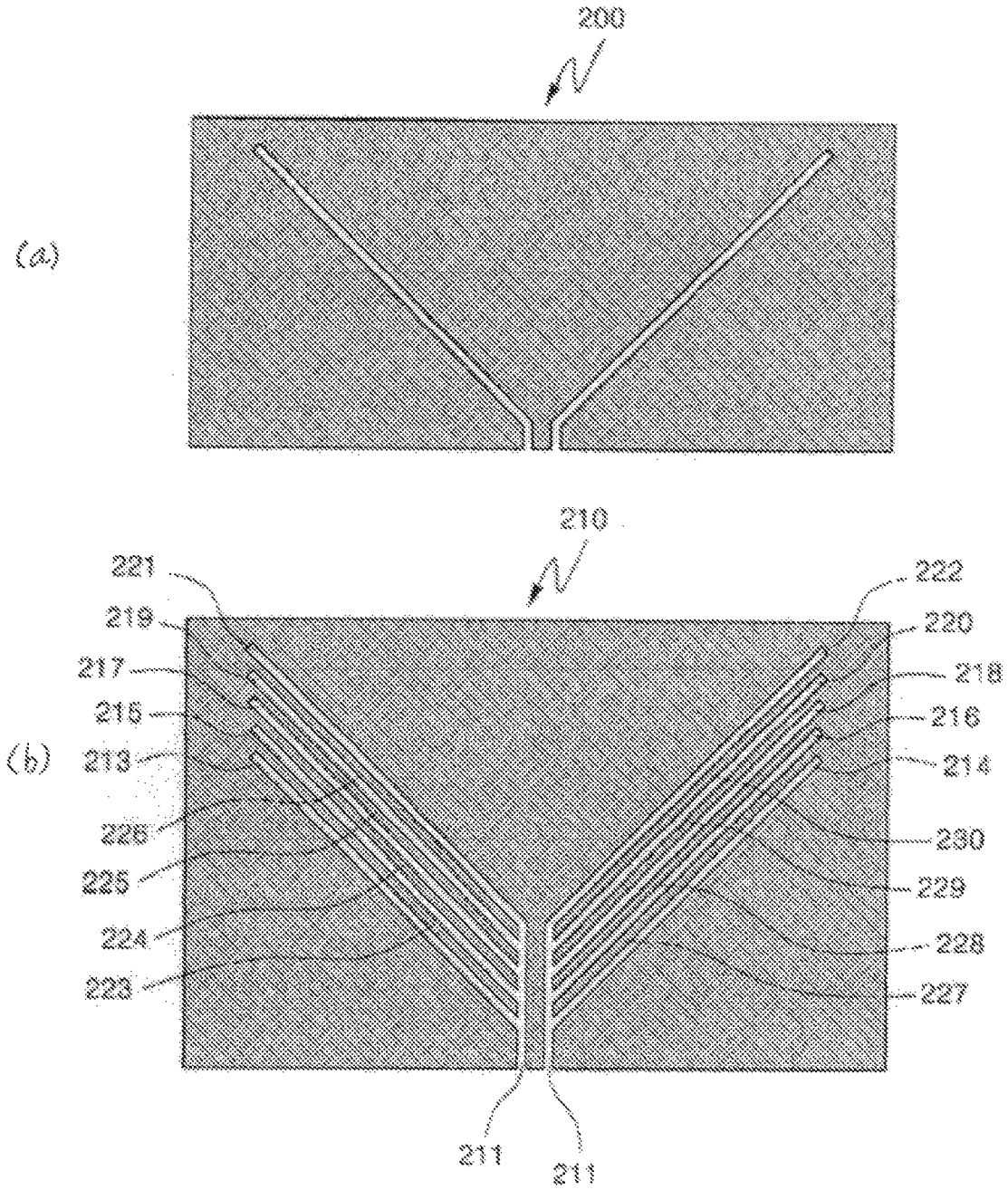
FIGS. 4 (*a*) and (*b*) illustrates a configuration of a V-shaped radiation slot pattern included in an augmented antenna according to an embodiment of the present invention.

Referring to FIG. 4, the V-shaped radiation slot pattern 210 which may be included in the augmented antenna according to an embodiment of the present invention may include a plurality of radiation slots 213, 215, 217, 219 and 221 which are formed on a substrate in order of resonant frequency and operate with positive signal components, and a plurality of radiation slots 214, 216, 218, 220 and 222 which are formed on the same substrate to constitute a slot dipole antenna with the radiation slots operating with positive signal components, are arranged in order of resonant frequency and operate with negative signal components.

Here, while the radiation slot pattern 210 may be formed in various V shapes, the V-shape radiation slot pattern 210 is preferably formed in a V shape having a right angle between two sides thereof. Precisely, the radiation slots do not form a V shape having a right angle between two sides thereof. Rather, extension lines of the radiation slots in the length direction can form a V shape having a right angle between two sides thereof.

The radiation slots 213, 215, 217, 219 and 221 operating with positive signal components are formed in parallel on the substrate in order of resonant frequency. The radiation slots 213, 215, 217, 219 and 221 and the radiation slots 214, 216, 218, 220 and 222 are arranged in the form of a slot dipole antenna in a V shape.

The radiation slots 213, 215, 217, 219 and 221 operating with positive signal components are formed at a predetermined interval and electromagnetically connected to a power feeder 211, and thus multiple coupling regions 223, 224, 225 and 226 are formed between neighboring radiation slots.

In addition, the radiation slots 213, 215, 217, 219 and 221 operating with positive signal components respectively have sequentially increasing resonant frequencies. Specifically, the radiation slots 213, 215, 217, 219 and 221 may include the first radiation slot 213 operating with a positive signal component, the third radiation slot 215 which is formed at a predetermined distance from the first radiation slot and has a resonant frequency higher than that of the first radiation slot, the fifth radiation slot 217 which is formed next to the third radiation slot, at a predetermined distance therefrom, and has a resonant frequency higher than that of the third radiation slot, the seventh radiation slot 219 which is formed next to the fifth radiation slot, at a predetermined distance therefrom, and has a resonant frequency higher than that of the fifth radiation slot, and the ninth radiation slot 221 which is formed next to the seventh radiation slot, at a predetermined distance therefrom, and has a resonant frequency higher than that of the seventh radiation slot.

The radiation slots 214, 216, 218, 220 and 222 operating with negative signal components are formed in parallel on the substrate in order of resonant frequency. The radiation slots 214, 216, 218, 220 and 222 and the radiation slots 213, 215, 217, 219 and 221 are arranged in the form of a slot dipole antenna in a V shape.

The radiation slots 214, 216, 218, 220 and 222 operating with negative signal components are formed at a predetermined interval and electromagnetically connected to a power feeder 212, and thus multiple coupling regions 227, 228, 229 and 230 are formed between neighboring radiation slots.

In addition, the radiation slots 214, 216, 218, 220 and 222 operating with positive signal components respectively have sequentially increasing resonant frequencies. Specifically, the radiation slots 214, 216, 218, 220 and 222 may include the second radiation slot 214 operating with a negative signal component, the fourth radiation slot 216 which is formed at a predetermined distance from the second radiation slot and has a resonant frequency higher than that of the second radiation slot, the sixth radiation slot 218 which is formed next so the fourth radiation slot, at a predetermined distance therefrom, and has a resonant frequency higher than that of the fourth radiation slot, the eighth radiation slot 220 which is formed next to the sixth radiation slot, at a predetermined distance therefrom, and has a resonant frequency higher than that of the sixth radiation slot, and the tenth radiation slot 222 which is formed next to the eighth radiation slot, at a predetermined distance therefrom, and has a resonant frequency higher than that of the eighth radiation slot.

While the five radiation slots operating with positive signal components and the five radiation slots operating with negative signal components are shown in FIG. 4, the number of radiation slots is not limited to five and the radiation slot pattern may be formed in various manners using two or more radiation slots.

The V-shaped radiation slot pattern 210 that may be included in the augmented antenna according to an embodiment of the present invention will now be described in more detail with reference to FIG. 4. The first radiation slot 213 operating with a positive signal component and the second radiation slot 214 operating with a negative signal component are perpendicular to each other on the basis of the power feeders 211 and 212. The third radiation slot 215 having a resonant frequency higher than that of the first radiation slot 213 is formed at a predetermined distance from the first radiation slot 213 and electromagnetically connected to the first radiation slot 213 to form the proximity coupling region 223. The fourth radiation slot 216 having a resonant frequency higher than that of the second: radiation slot 214 is formed at a predetermined distance from the second radiation slot 214 and electromagnetically connected to the second radiation slot 214 to form the proximity coupling region 227.

The fifth radiation slot 217 having a resonant frequency higher than that of the third radiation slot 215 is formed at a predetermined distance from the third radiation slot 215 and electromagnetically connected to the third radiation slot 215 to form the proximity coupling region 224. The sixth radiation slot 218 having a resonant frequency higher than that of the fourth radiation slot 215 is formed at a predetermined distance from the fourth radiation slot 216 and electromagnetically connected to the fourth radiation slot 216 to form the proximity coupling region 228.

The seventh radiation slot 219 having a resonant frequency higher than that of the fifth radiation slot 217 is formed at a predetermined distance from the fifth radiation slot 217 and electromagnetically connected to the fifth radiation slot 217 to form the proximity coupling region 225. The eighth radiation slot 220 having a resonant frequency higher than that of the sixth radiation slot 218 is formed at a predetermined distance from the sixth radiation slot 218 and electromagnetically connected to the sixth radiation slot 218 to form the proximity coupling region 229.

In addition, the ninth radiation slot 221 having a resonant frequency higher than that of one seventh radiation slot 219 is formed at a predetermined distance from the seventh radiation slot 219 and electromagnetically connected to the seventh radiation slot 219 to form the proximity coupling region 226. The tenth radiation slot 222 having a resonant frequency higher than that of the eighth radiation slot 220 is formed at a predetermined distance from the eighth radiation slot 220 and electromagnetically connected to the eighth radiation slot 220 to form the proximity coupling region 230.

The V-shaped radiation slot pattern 210 that may be included in the augmented antenna according to an embodiment of the present invention has the following characteristics. As shown in FIG. 6, reflection coefficient S11 of less than −10 dB of the radiation slot pattern 210 corresponds to a bandwidth of 400 MHZ ranging from 2.2 GHz to 2.6 GHz. Such bandwidth is double the bandwidth of a V-shaped single slot dipole antenna pattern 200, shown in FIG. 5. Such bandwidth improvement is achieved according to multi-coupling obtained by the radiation slots of the radiation slot pattern 210.

A description will be given of a double augmented antenna according to an embodiment of the present invention with reference to FIGS. 7, 8 and 9.

Figure 7:
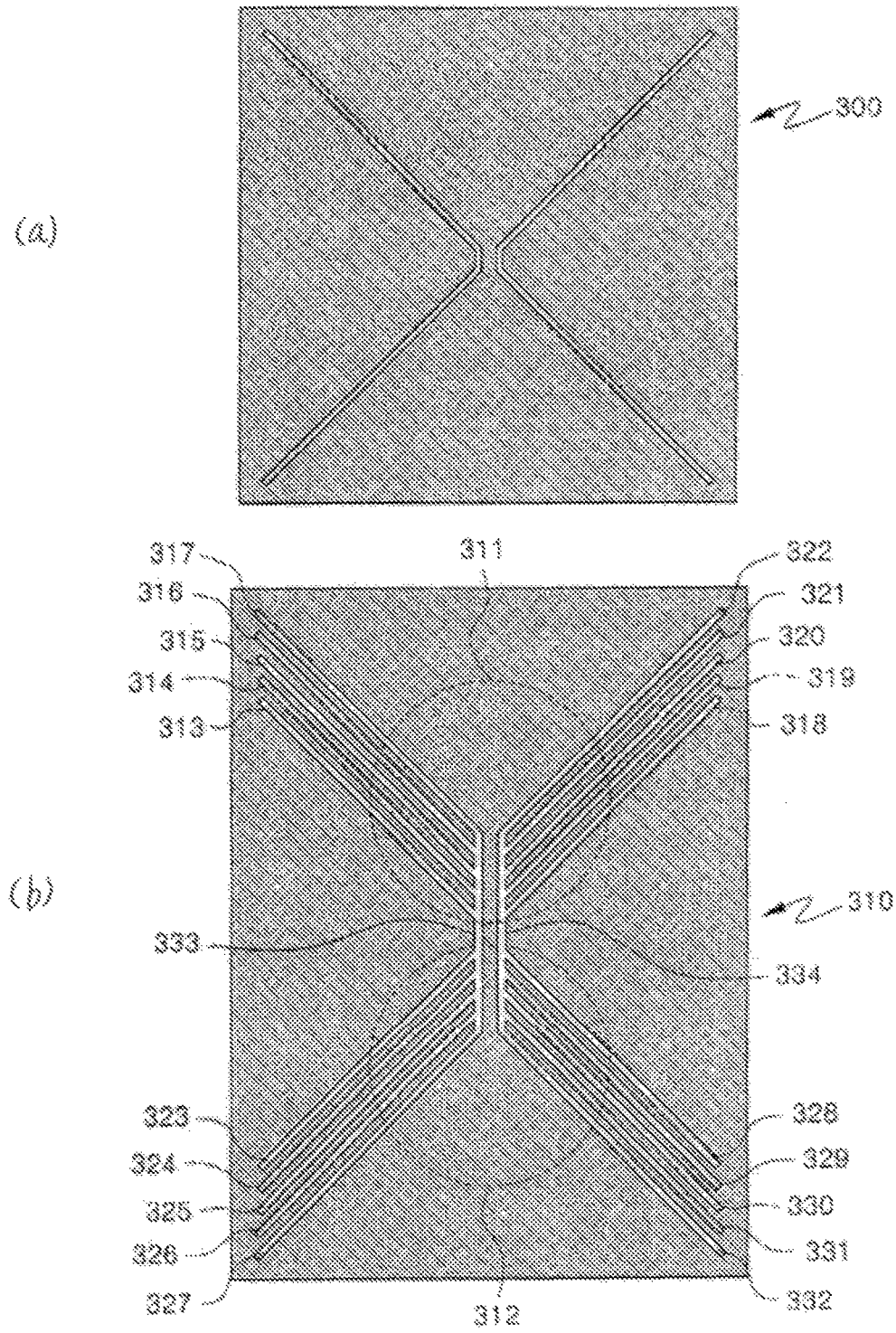
FIGS. 7 (*a*) and (*b*) illustrates a configuration of a double augmented antenna according to an embodiment of the present invention.

Referring to FIG. 7, the double augmented antenna 310 according to an embodiment of the present invention may include two radiation slot patterns 311 and 112 which are symmetrically formed in such a manner that ends of power feeders thereof are connected to each other.

Each of the radiation slot patterns 311 and 312 may include a plurality of radiation slots operating with positive signal components and a plurality of radiation patterns operating with negative signal components, which are formed in a V shape on the basis of the power feeders. The radiation slot patterns 311 and 312 face each other in a symmetrical form on one basis of the power feeders and are electromagnetically connected to each other to form the double augmented antenna. While the double augmented antenna may be formed in various V shapes, the double augmented antenna is preferably formed in a V shape having a right angle between two sides thereof (precisely, the radiation slots do not form a V shape having a right angle between two sides thereof, and extension lines of the radiation slots in the length direction can form a V shape having a right angle between two sides thereof).

After formation of the two radiation slot patterns 311 and 312 in a symmetrical form, the radiation slot patterns 311 and 312 are electromagnetically connected to each other according to electromagnetic connection of the power feeders thereof. The power feeders are preferably connected to each other while being impedance-matched. Specifically, the power feeder of the first radiation slot pattern 311, which relates to positive signal components, and the power feeder of the second radiation slot pattern 312, which relates to negative signal components, are preferably impedance-matched and electromagnetically connected to each other (333), and the power feeder of the first radiation slot pattern 311, which relates to negative signal components, and the power feeder of the second radiation slot pattern 312, which relates to positive signal components, are preferably impedance-matched and electromagnetically connected to each other (334).

In addition, the two radiation slot patterns 311 and 312 are preferably formed on a substrate disposed on one side of a dielectric layer. Here, the dielectric layer may be a PCB.

The substrate on which the radiation slot patterns 311 and 312 are formed may be made of various materials. Preferably, the substrate may be formed of a metal, polysilicon, ceramic, carbon fiber, conductive ink, conductive paste, ITO (Indium Tin Oxide), CNT (Carbon Nano Tube) or conductive polymer.

When the radiation slot patterns 311 and 312 are formed on a metal layer, the metal layer is preferably formed from a metal plate. The radiation slot patterns 311 and 312 can be formed on the metal plate and applied to the surfaces of various products. Accordingly, the radiation slot patterns 311 and 312 can be applied to the surface of electronics made of a metal to improve propagation environment around the electronics.

The double augmented antenna according to an embodiment of the present invention will now be described in more detail with reference to FIG. 7. The double augmented antenna is formed in a symmetrical form on the basis of the power feeders 333 and 334 and may include the two radiation slot patterns 311 and 312 which are impedance-matched and reradiate radio waves.

The first radiation slot pattern 311 may include a radiation pattern 313 operating with a positive signal component and a radiation slot 318 which is perpendicular to the radiation slot 313 on the basis of the power feeders and operates with a negative signal component. In addition, a plurality of radiation slots 314, 315, 316 and 317 respectively having sequentially increasing resonant frequencies, which are higher than the resonant frequency of the radiation slot 313, are sequentially formed next to the radiation slot 313 at a predetermined interval and electromagnetically connected. A plurality of radiation slots 319, 320, 321 and 322 respectively having sequentially increasing resonant frequencies, which are higher than the resonant frequency of the radiation slot 318, are sequentially formed next to the radiation slot 318 at a predetermined interval and electromagnetically connected.

The second radiation slot of pattern 312 may include a radiation pattern 338 operating with a positive signal component and a radiation slot 323 which is perpendicular to the radiation slot 328 on the basis of the power feeders and operates with a negative signal component. In addition, a plurality of radiation slots 329, 330, 331 and 332 respectively having sequentially increasing resonant frequencies, which are higher than the resonant frequency of the radiation slot 328, are sequentially formed next to the radiation slot 328 at a predetermined interval and electromagnetically connected. A plurality of radiation slots 324, 325, 326 and 327 respectively having sequentially increasing resonant frequencies, which are higher than the resonant frequency of the radiation slot 323, are sequentially formed next to the radiation slot 323 at a predetermined interval and electromagnetically connected.

The first radiation slot pattern 311 and the second radiation slot pattern 312 are connected to each other in such a manner that one end of the power feeders 333 and 334 of the first radiation slot pattern 311 and one end of the power feeders 333 and 334 of the second radiation slot pattern 312 are connected to each other in a symmetrical form, impedance-matched and electromagnetically connected to each other.

Since the double augmented antenna can receive radio waves in a wide frequency band and reradiate the radio waves, the double augmented antenna can be used to improve the propagation environment of a wireless communication system and extend the coverage thereof according to such characteristics.

Specifically, a radio signal received by the first radio slot pattern 311 included in the double augmented antenna is transmitted to the second radiation slot pattern 312 with maximum efficiency according to impedance matching and radiated and, simultaneously, a radio signal received by the second radiation slot pattern 312 is transmitted to the first radiation slot pattern 311 with maximum efficiency according to impedance matching and radiated. Accordingly, a radio signal can be received and reradiated with maximum efficiency according to impedance matching to augment waves around the augmented antenna.

Figure 8:
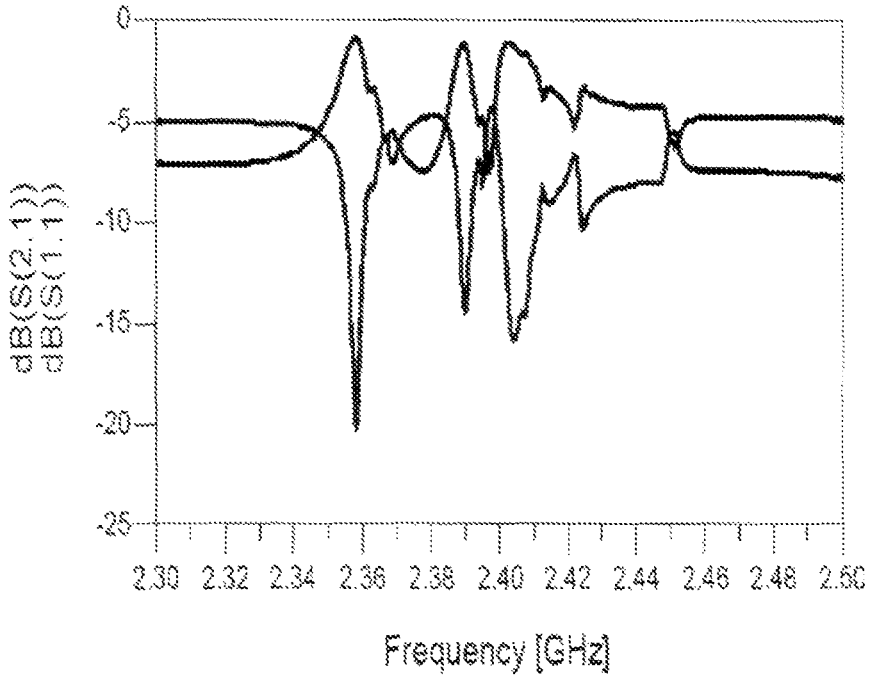
FIG. 8 is a graph showing reflection coefficient and transfer coefficient characteristics of the double augmented antenna according to an embodiment of the present invention.
Figure 9:
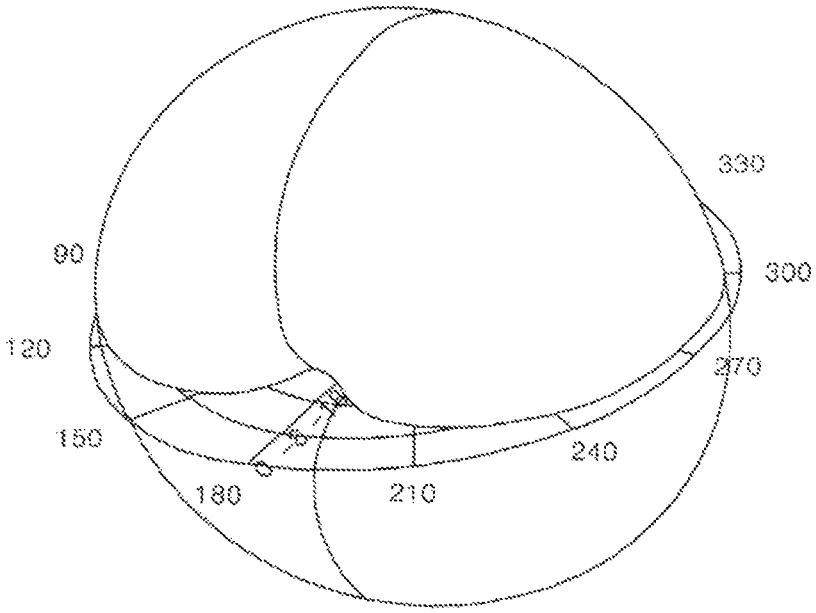
FIG. 9 shows propagation and radiation characteristics of the double augmented antenna according to an embodiment of the present invention.

Referring to FIG. 8, reflection coefficient S11 and transfer coefficient S21 at the power feeders 333 and 334 with respect to the first radiation slot pattern 311 and the second radiation slot pattern 312 of the double augmented antenna 310 can be confirmed. Referring to FIG. 9, the form of a radio wave radiated from the double augmented antenna 310 can be confirmed.

As described above, since the double augmented antenna 310 according to an embodiment of the present invention forms multiple coupling regions using a plurality of radiation slots, the double augmented antenna 310 can transmit and receive radio signals in a wider bandwidth than an antenna pattern 300 shown in the upper part of FIG. 7, thereby improving propagation environments.

A description will be given of a quadruple augmented antenna according to an embodiment of the present invention with reference to FIG. 10 to 17.

Referring to FIGS. 10 to 17, the quadruple augmented antenna 410 according to an embodiment of the present invention may include four radiation slot patterns 421, 422, 423 and 424 which are symmetrically formed in such a manner that ends of power feeders thereof are connected.

Each of the four radiation slot patterns 421, 422, 423 and 424 may include a plurality of radiation slots operating with positive signal components and a plurality of radiation patterns operating with negative signal components, which are formed in a V shape on the basis of the power feeders. The four radiation slot patterns 421, 422, 423 and 424 are symmetrically formed on the basis of the power feeders and electromagnetically connected to form the quadruple augmented antenna. While the quadruple augmented antenna may be formed in various V shapes, the quadruple augmented antenna is preferably formed in a V shape having a right angle between two sides thereof (precisely, the radiation slots do not form a V shape having a right angle between two sides thereof, and extension lines of the radiation slots in the length direction can form a V shape having a right angle between two sides thereof).

Figure 10:
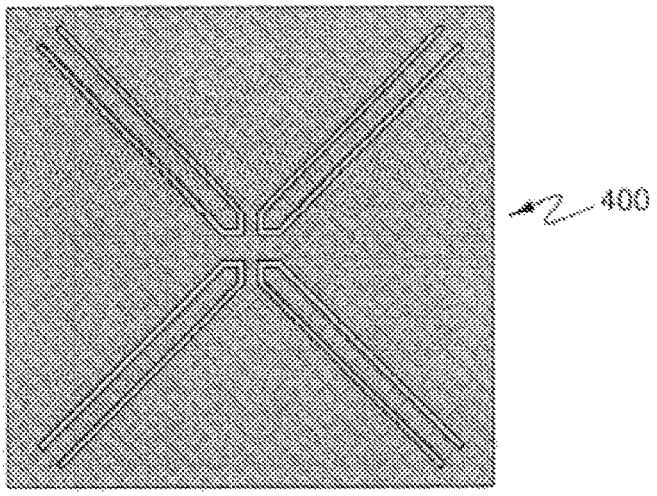
FIGS. 10 (*a*) and (*b*) illustrates a configuration of a quadruple augmented antenna according to an embodiment of the present invention.
Figure 10:
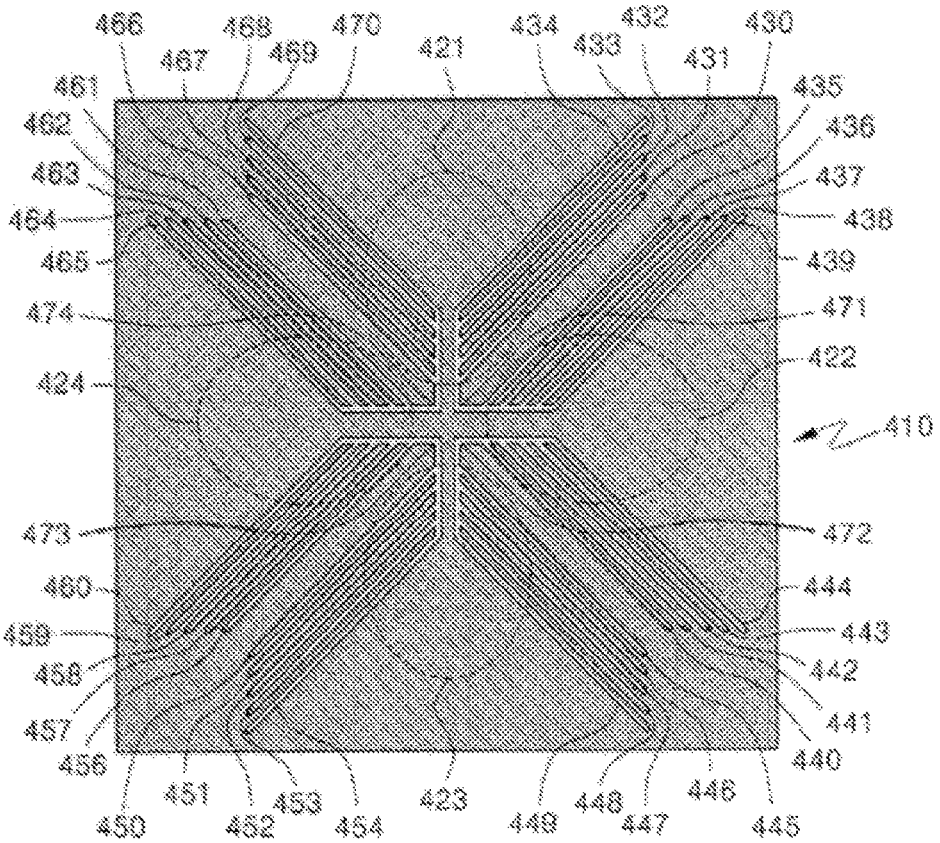

The four radiation slot patterns 421, 422, 423 and 424 are symmetrically formed with the vortexes of the v shapes thereof gathered at the center of the quadruple augmented antenna 410. In this case, one radiation slot pattern and a radiation slot pattern opposite thereto are symmetrical, and one radiation slot pattern and each of radiation slot patterns arranged on both sides thereof are symmetrical. Accordingly, when the V shape of each radiation pattern has a right angle between two sides thereof, the four radiation slot patterns can be arranged in the form of a cross or X according to the aforementioned symmetrical formation, as shown in FIG. 10.

After formation of the four radiation slot patterns 421, 422, 423 and 424 in a symmetrical form, the radiation slot patterns 421, 422, 423 and 424 are electromagnetically connected according to electromagnetic connection of the power feeders thereof. The power feeders are preferably connected while being impedance-matched. Specifically, the power feeder of the first radiation slot pattern 421, which relates to positive signal components, and the power feeder of the fourth radiation, slot pattern 424, which relates to negative signal components, are preferably impedance-matched and electromagnetically connected to each other (474), and the power feeder of the second radiation slot pattern 422, which relates to positive signal components, and the power feeder of the first radiation slot pattern 421, which relates to negative signal components, are preferably impedance-matched and electromagnetically connected to each other (471). In addition, the power feeder of the third radiation slot pattern 423, which relates to positive signal components, and the power feeder of the second radiation slot pattern 422, which relates to negative signal components, are preferably impedance-matched and electromagnetically connected to each other (472), and the power feeder of the fourth radiation slot pattern 424, which relates to positive signal components, and the power feeder of the third radiation slot pattern 423, which relates to negative signal, components, are preferably impedance-matched and electromagnetically connected to each other (473).

In addition, the four radiation slot pattern 421, 422, 423 and 424 are preferably formed on a substrate disposed on one side of a dielectric layer. Here, the dielectric layer may be a PCB.

The substrate on which the radiation slot patterns 421, 422, 423 and 424 are formed may be made of various materials. Preferably, the substrate may be formed of a metal, polysilicon, ceramic, carbon fiber, conductive ink, conductive paste, ITO (Indium Tin Oxide), CNT (Carbon Nano Tube) or conductive polymer.

When the radiation slot patterns 421, 422, 423 and 424 are formed on a metal layer, the metal layer is preferably formed from a metal plate. The radiation slot patterns 421, 422, 423 and 424 are formed on the metal plate and applied to the surfaces of various products. Accordingly, the radiation slot patterns 421, 422, 423 and 424 can be applied to the surface of electronics made of a metal to improve propagation environment around the electronics.

The quadruple augmented antenna according to an embodiment of the present invention will now be described in more detail with reference to FIG. 10. The quadruple augmented, antenna has a symmetrical form on the basis of the power feeders 471, 472, 473 and 474 and may include the four radiation slot patterns 421, 422, 423 and 424 which are impedance-matched and reradiate radio waves.

The first radiation slot pattern 421 may include a radiation pattern 466 operating with a positive signal component and a radiation slot 430 which is perpendicular to the radiation slot 466 on the basis of the power feeders and operates with a negative signal component. In addition, a plurality of radiation slots 467, 468, 469 and 470 respectively having sequentially increasing resonant frequencies, which are higher than the resonant frequency of the radiation slot 466, are sequentially formed next to the radiation slot 466 at a predetermined interval and electromagnetically connected. A plurality of radiation slots 431, 432, 433 and 434 respectively having sequentially increasing resonant frequencies, which are higher than the resonant frequency of the radiation slot 430, are sequentially formed next to the radiation slot 430 at a predetermined interval and electromagnetically connected.

The second radiation slot pattern 422 may include a radiation pattern. 435 operating with a positive signal component and a radiation slot 440 which is perpendicular to the radiation slot 433 on the basis of the power feeders and operates with a negative signal component. In addition, a plurality of radiation slots 436, 437, 438 and 439 respectively having sequentially increasing resonant frequencies, which are higher than the resonant frequency of the radiation slot 435, are sequentially formed next to the radiation slot 435 at a predetermined interval and electromagnetically connected. A plurality of radiation slots 441, 442, 443 and 444 respectively having sequentially increasing resonant frequencies, which are higher than one resonant frequency of the radiation slot 440, are sequentially formed next to the radiation slot 440 at a predetermined interval and electromagnetically connected.

The third radiation slot pattern 423 may include a radiation pattern 445 operating with a positive signal component and a radiation slot 450 which is perpendicular to the radiation slot 445 on the basis of the power feeders and operates with a negative signal component. In addition, a plurality of radiation slots 446, 447, 448 and 449 respectively having sequentially increasing resonant frequencies, which are higher then the resonant frequency of the radiation slot 445, are sequentially formed next to the radiation slot 445 at a predetermined interval and electromagnetically connected. A plurality of radiation slots 451, 452, 453 and 454 respectively having sequentially increasing resonant frequencies, which are higher than the resonant frequency of the radiation slot 450, are sequentially formed next to the radiation slot 450 at a predetermined interval and electromagnetically connected.

The fourth radiation slot pattern 424 may include a radiation pattern 456 operating with a positive signal component and a radiation slot 461 which is perpendicular to the radiation slot 456 on the basis of the power feeders and operates with a negative signal component. In addition, a plurality of radiation slots 457, 458, 459 and 460 respectively having sequentially increasing resonant frequencies, which are higher than the resonant frequency of the radiation slot 456, are sequentially formed next to the radiation slot 456 at a predetermined interval and electromagnetically connected. A plurality of radiation slots 462, 463, 464 and 465 respectively having sequentially increasing resonant frequencies, which are higher than the resonant frequency of the radiation slot 461, are sequentially formed next to the radiation slot 461 at a predetermined interval and electromagnetically connected.

The first to fourth radiation slot patterns 421, 422, 423 and 424 are symmetrically formed with the vortexes of the V shapes thereof gathered at the center of the quadruple augmented antenna. In this case, one radiation slot pattern and a radiation slot patters opposite thereto are symmetrical, and one radiation slot pattern and each of radiation slot patterns arranged on both sides thereof are symmetrical. For example, the first radiation slot pattern 421 and the third radiation slot pattern 423, which is formed opposite to the first radiation slot pattern 421 on the basis of the power feeders, are symmetrical. In addition, the first radiation slot pattern 421 and each of the second and fourth radiation slot patterns 422 and 424 formed on both sides of the first radiation slot pattern 421 are symmetrical. Accordingly, when the V shape of each radiation pattern has a right angle between two sides thereof, the four radiation slot patterns can be arranged in the form of a cross or X according to the aforementioned symmetrical formation, as shown in FIG. 10.

Since the quadruple augmented antenna can receive radio waves in a wide frequency band and reradiate the radio waves, the quadruple augmented antenna can be used to improve the propagation environment of a wireless communication system and extend the coverage thereof according to such characteristics.

Specifically, a radio signal received by the first radio slot pattern 421 is transmitted to the third radiation slot pattern 423 with maximum efficiency according to impedance matching and radiated and, simultaneously, a radio signal received by the third radiation, slot pattern 423 is transmitted to the first radiation slot pattern 421 with maximum efficiency according to impedance matching and radiated. A radio signal received by the second radiation slot pattern 422 is transmitted to the fourth radiation slot pattern 424 with maximum efficiency according to impedance matching and radiated and, simultaneously, a radio signal received by the fourth radiation slot pattern 424 is transmitted to the second radiation slot pattern 422 with maximum efficiency according to impedance matching and radiated.

Radio signals received through the first, second, third and fourth radiation slot patterns 421, 422, 423 and 424 may be applied to not only opposite radiation slot patterns but also neighboring radiation slot patterns on both sides of the radiation slot patterns. Part of a radio signal received by the first radiation slot pattern 421 is applied to the second and fourth radiation slot patterns 422 and 424 and radiated therefrom and part of a radio signal received by the second radiation slot pattern 422 is applied to the first and third radiation clot patterns 421 and 423 and radiated therefrom. In addition, part of a radio signal received by the third radiation slot pattern 423 is applied to the second and fourth radiation slot patterns 422 and 424 and radiated therefrom and part of a radio signal received by the fourth radiation slot pattern 424 is applied to the first and third radiation slot patterns 421 and 423 and radiated therefrom.

Consequently, the quadruple augmented antenna receives radio signals and reradiates the radio signals with maximum efficiency according to impedance matching through the aforementioned process, to thereby augment waves around the augmented antenna.

Figure 11:
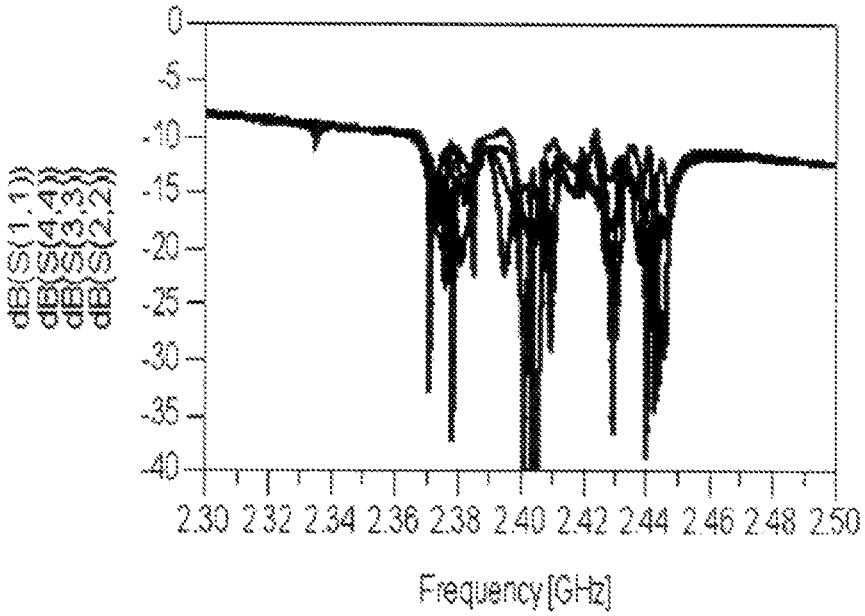
FIGS. 11, 12 (*a*) and (b) and 13 (*a*) and (*b*) are graphs showing reflection coefficient characteristics of the quadruple augmented antenna according to an embodiment of the present invention.
Figure 12:
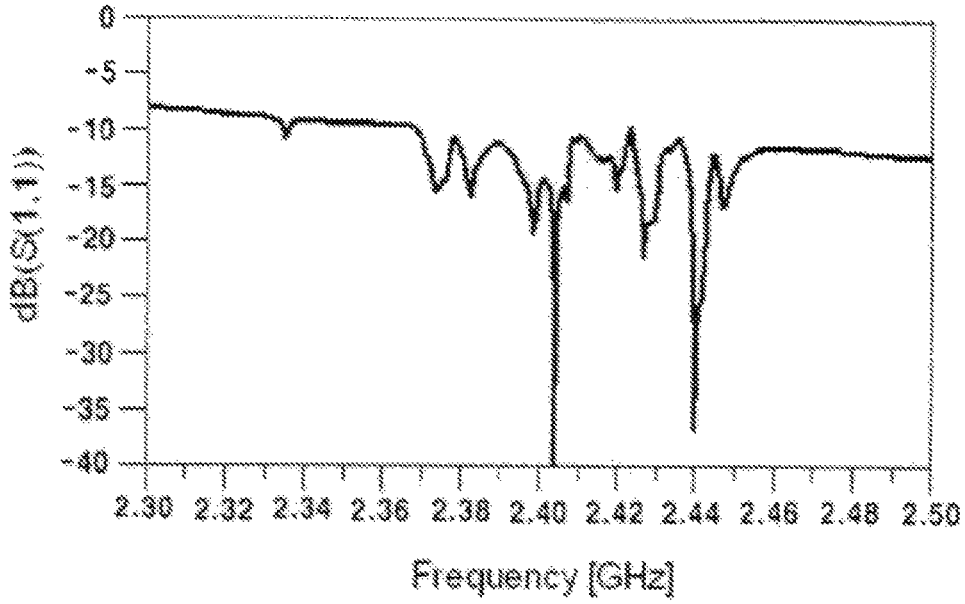
Figure 12:
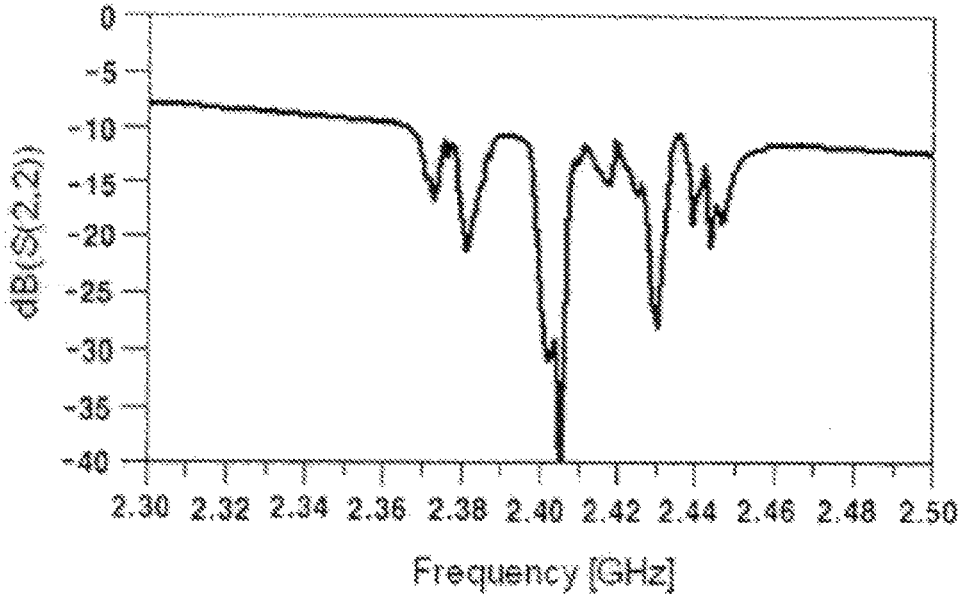
Figure 13:
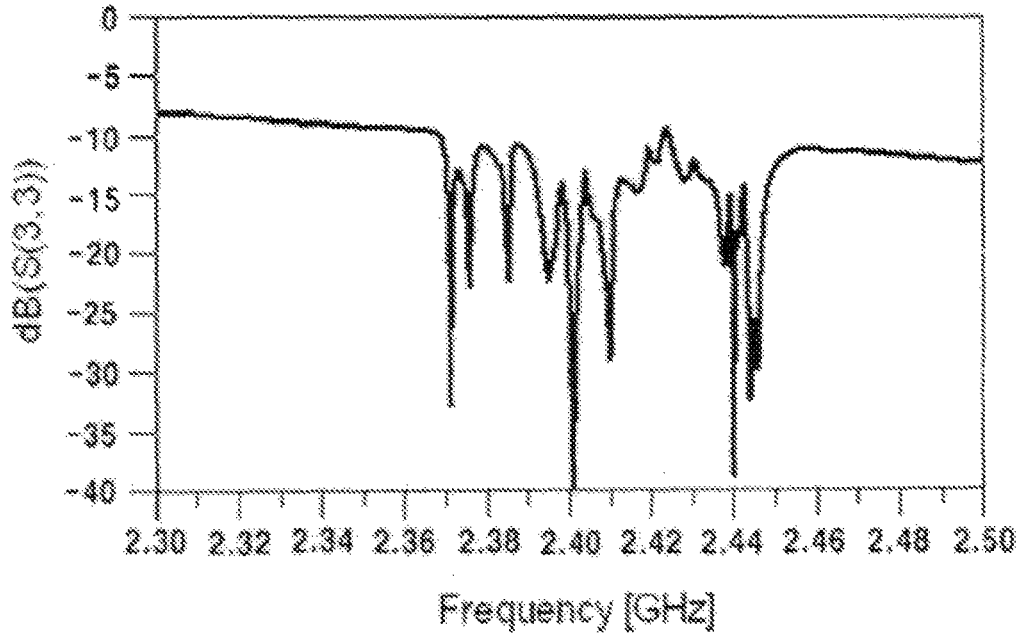
Figure 13:
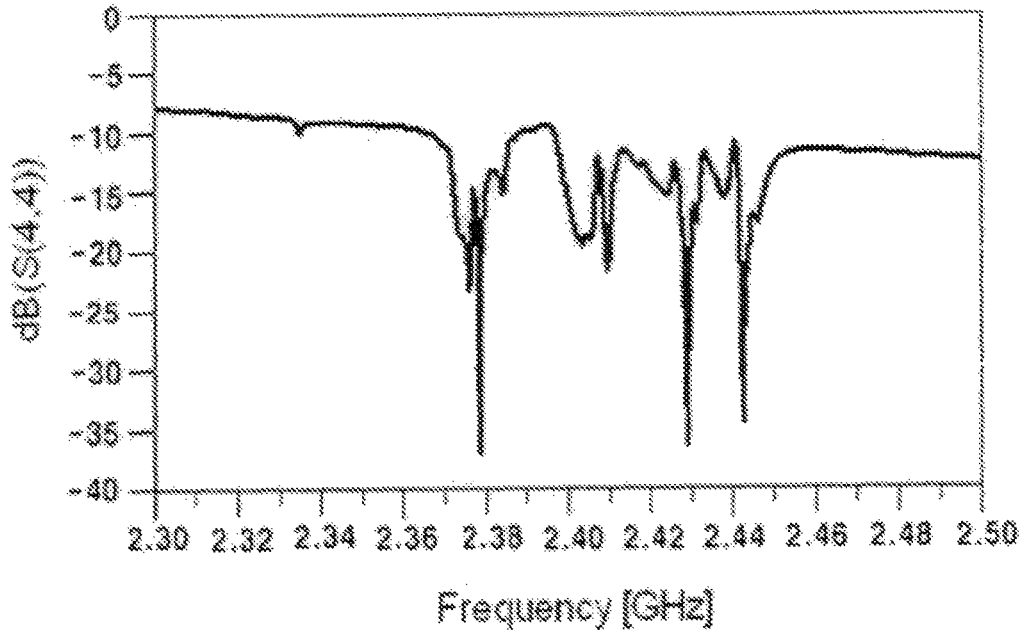

Referring to FIGS. 11, 12 and 13, reflection coefficients S11, S22, S33 and S44 respectively at the power feeders 471 and 474, the power feeders 471 and 472, the power feeders 472 and 473 and the power feeders 473 and 474 with respect to the first, second, third and fourth radiation slot patterns 421, 422, 423 and 424 of the quadruple augmented antenna 410 can be confirmed.

Figure 14:
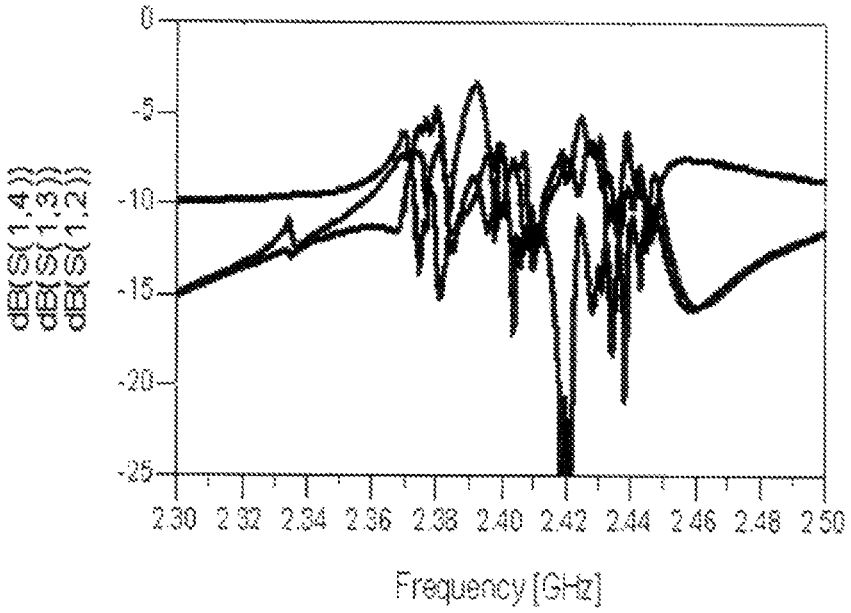
FIGS. 14 and 15 (*a*)-(*c*) are graphs showing transfer coefficient characteristics of the quadruple augmented antenna according to an embodiment of the present invention.
Figure 15:
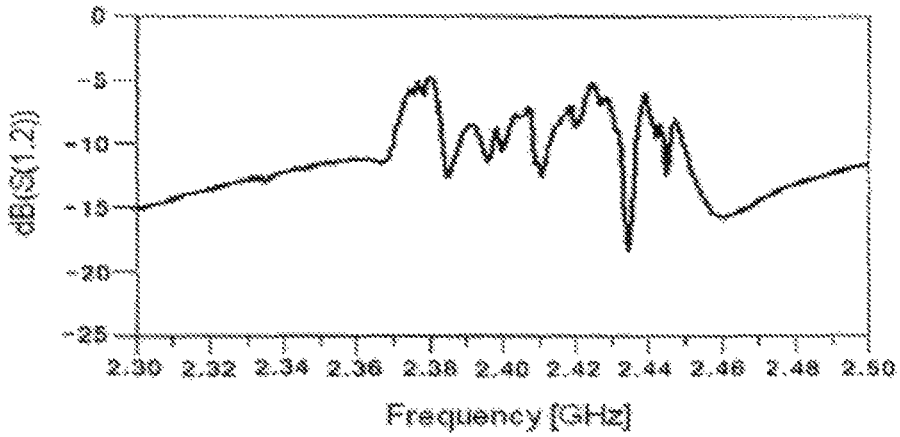
Figure 15:
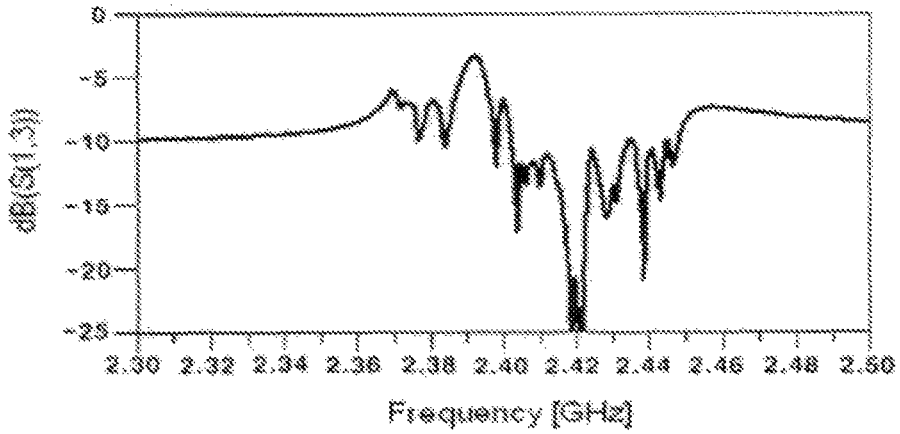
Figure 15:
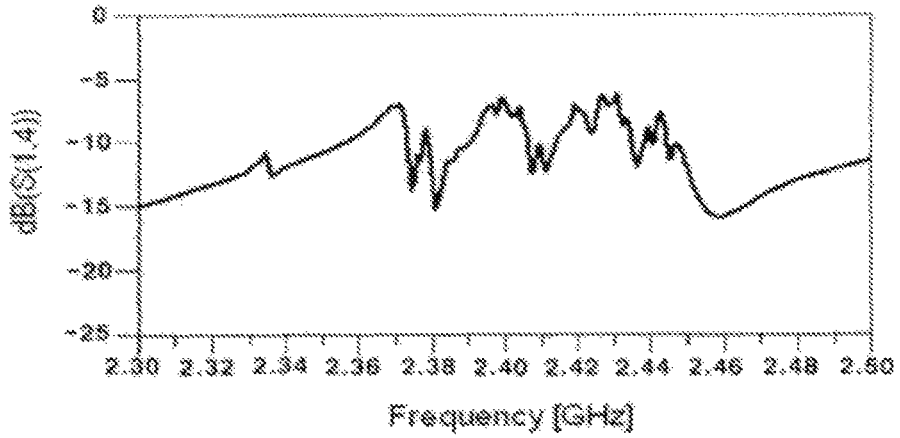

Referring to FIGS. 14 and 15, transfer coefficients S21, S31 and S41 at she power feeders 471 and 474, the power feeders 471 and 472, power feeders 472 and 473 and the power feeders 473 and 474 with respect to the first, second, third and fourth radiation slot patterns 421, 422, 423 and 424 of the quadruple augmented antenna 410 can be confirmed.

Figure 16:
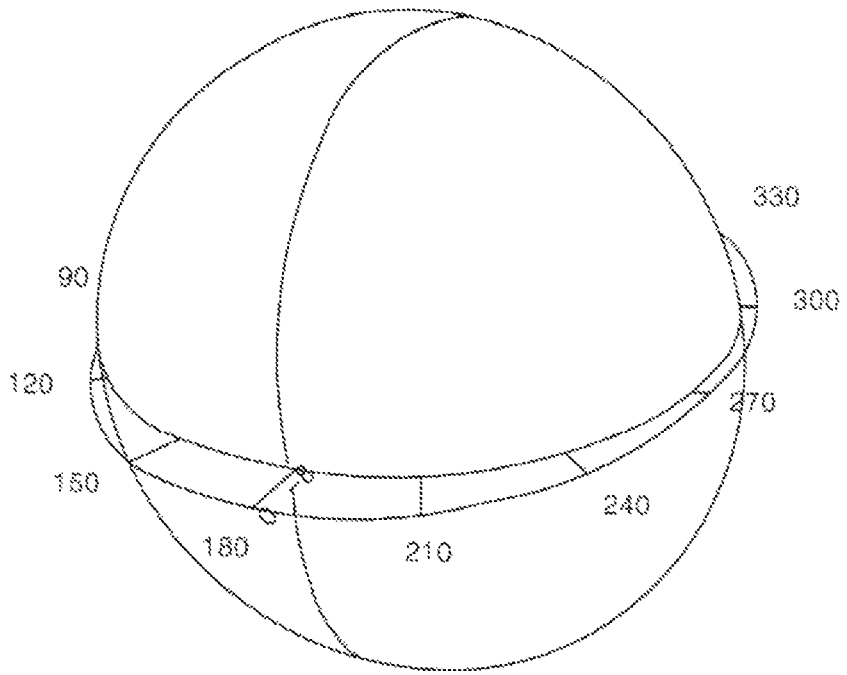
FIG. 16 shows propagation and radiation characteristics of the quadruple augmented antenna according to an embodiment of the present invention.
Figure 17:
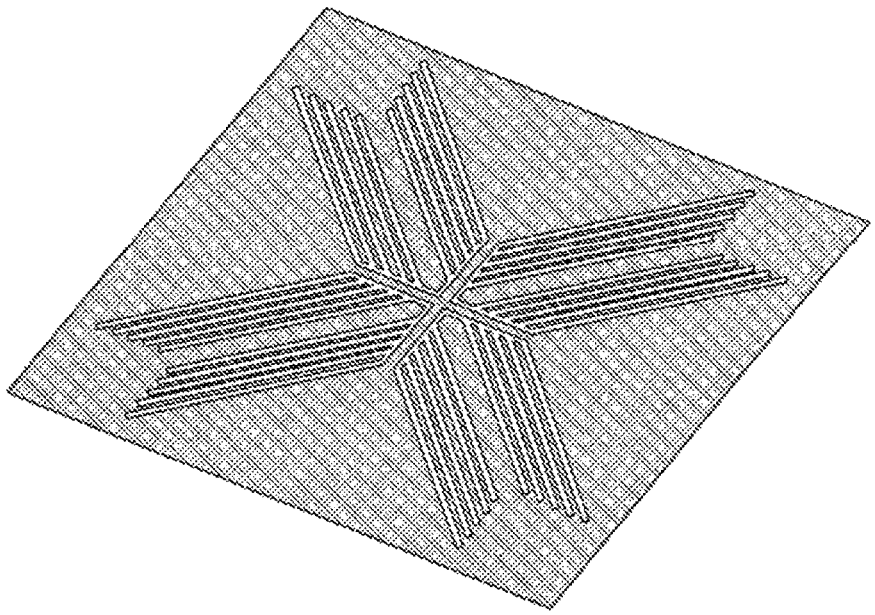
FIG. 17 illustrates a quadruple augmented antenna implemented on a dielectric layer according to an embodiment of the present invention.

Referring to FIG. 16, the form of a radio wave radiated from the quadruple augmented antenna 410 can be confirmed. The quadruple augmented antenna radiates radio waves in a spherical form in which radio waves are uniformly radiated in every direction. Radio wave radiation characteristics of the quadruple augmented antenna are improved compared to those of the double augmented antenna, shown in FIG. 9.

As described above, since the quadruple augmented antenna 410 according to an embodiment of the present invention forms multiple coupling regions using a plurality of radiation slots, the quadruple augmented antenna 410 can transmit and receive radio signals in a wider bandwidth than an antenna pattern 400 shown in the upper part of FIG. 10, thereby improving propagation environments.

The aforementioned augmented antennas according to embodiments of the present invention can extend the coverage of a wireless communication system by simultaneously transmitting and receiving radio signals in a free space having a poor propagation environment.

Furthermore, the augmented antennas according to embodiments of the present invention can improve propagation environments without exposing terminals to multi-path fading.

Moreover, the augmented antennas according to embodiments of the present invention can improve the propagation environments at a low cost without increasing the number of relays or micro base stations.

In addition, the augmented antennas according to embodiments of the present invention can reradiate radio waves in a wide frequency bandwidth through multi-coupling induction, thereby improving propagation environments in a wide frequency band.

Furthermore, an antenna pattern for propagation environment improvement in the augmented antennas according to embodiments of the present invention, can be formed flat on a dielectric layer. Accordingly, the augmented antennas can be manufactured in the form of a sheet or sticker and applied to the surface of various products to improve propagation environments.

The present invention may, however, be embodied in many alternate forma and should not be construed as limited to the embodiments set forth herein. Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention as defined by the claims.

The invention claimed is:

1. An augmented antenna, comprising:

a plurality of radiation slots formed in parallel on a substrate in order of resonant frequency and operating with positive signal components; and a plurality of radiation slots formed in parallel on the same substrate in order of resonant frequency and operating with negative signal components, wherein the plurality of radiation slots operating with positive signal components and the plurality of radiation slots operating with negative signal components are arranged in a form of a slot dipole antenna, wherein the plurality of radiation slots operating with positive signal components and the plurality of radiation slots operating with negative signal components are arranged in a V shape with respect to power feeders to form first to fourth radiation slot patterns, and wherein the first to fourth radiation slot patterns are formed in a symmetrical manner to one another in such a manner that opposite ones of the first to fourth radiation slot patterns are symmetrically arranged to each other and neighboring ones of the first to fourth radiation slot pattern s are symmetrically arranged to each other, so that radio waves received by one of the first to fourth radiation slot patterns are applied to the remaining ones of the first to fourth radiation slot patterns and re-radiated with maximum efficiency.

2. The augmented antenna of claim 1, wherein the plurality of radiation slots operating with positive signal components are formed at a predetermined interval and electromagnetically connected to form multiple coupling regions between neighboring ones of the plurality of radiation slots, and the plurality of radiation slots operating with negative signal components are formed at a predetermined interval and electromagnetically connected to form multiple coupling regions between neighboring ones of the plurality of radiation slots.

3. The augmented antenna of claim 1, wherein the plurality of radiation slots operating with positive signal components and the plurality of radiation slots operating with negative signal components are formed in a line with respect to the power feeders.

4. The augmented antenna of claim 1, wherein the power feeders are impedance-matched and electromagnetically connected.

5. The augmented antenna of claim 1, wherein a power feeder of the first radiation slot pattern, with respect to positive signal components, and a power feeder of the fourth radiation slot pattern, with respect to negative signal components, are impedance-matched and electromagnetically connected to each other, a power feeder of the second radiation slot pattern, with respect to positive signal components, and a power feeder of the first radiation slot pattern, with respect to negative signal components, are impedance-matched and electromagnetically connected to each other, a power feeder of the third radiation slot pattern, with respect to positive signal components, and a power feeder of the second radiation slot pattern, with respect to negative signal components, are impedance-matched and electromagnetically connected to each other, and a power feeder of the fourth radiation slot pattern, with respect to positive signal components, and a power feeder of the third radiation slot pattern, with respect to negative signal components, are impedance-matched and electromagnetically connected to each other.

6. The augmented antenna of claim 1, wherein the plurality of radiation slots operating with positive signal components and the plurality of radiation slots operating with negative signal components are formed on a substrate disposed on one side of a dielectric layer.

7. The augmented antenna of claim 1, wherein the substrate on which the plurality of radiation slots operating with positive signal components and the plurality of radiation slots operating with negative signal components are formed is a metal layer.

8. The augmented antenna of claim 7, wherein the metal layer is a metal plate formed on a surface of an electronic device.

* * * * *